US012498141B2

(12) United States Patent
Caldwell et al.

(10) Patent No.: US 12,498,141 B2
(45) Date of Patent: Dec. 16, 2025

(54) TILTABLE RADIANT HEATER

(71) Applicant: National Presto Industries, Inc., Eau Claire, WI (US)

(72) Inventors: Charles F. Caldwell, Eau Claire, WI (US); Brian Ruben, Eau Claire, WI (US)

(73) Assignee: National Presto Industries, Inc., Eau Claire, WI (US)

( * ) Notice: Subject to any disclaimer, the term of this patent is extended or adjusted under 35 U.S.C. 154(b) by 791 days.

(21) Appl. No.: 17/851,591

(22) Filed: Jun. 28, 2022

(65) Prior Publication Data

US 2023/0028879 A1 Jan. 26, 2023

Related U.S. Application Data

(60) Provisional application No. 63/224,042, filed on Jul. 21, 2021.

(51) Int. Cl.
*F24H 3/04* (2022.01)
*F24H 9/1863* (2022.01)

(52) U.S. Cl.
CPC ..... *F24H 3/0417* (2013.01); *F24H 9/1863* (2013.01)

(58) Field of Classification Search
CPC ..... H05B 3/16; F24H 9/1863; F24H 9/0417
See application file for complete search history.

(56) References Cited

U.S. PATENT DOCUMENTS 2,111,311 A * 3/1938 Child ..... H01H 13/16 200/332
3,178,533 A * 4/1965 Lory ..... H01H 50/20 200/16 R
3,204,069 A * 8/1965 West ..... H01H 13/063 200/531
3,342,174 A * 9/1967 Tongue ..... F24C 5/16 126/96
4,170,104 A * 10/1979 Yamagata ..... G04B 37/106 368/308
4,389,551 A * 6/1983 Deibele ..... H01R 13/7035 200/51.09
4,510,355 A * 4/1985 Atsumi ..... H01H 21/285 403/381
4,616,115 A * 10/1986 Potyka ..... G05G 9/04796 200/6 A
5,132,499 A * 7/1992 Valenzona ..... H01H 13/585 200/527
5,221,816 A * 6/1993 Williams ..... H01H 13/12 200/16 D
5,414,794 A * 5/1995 Shao ..... F24H 3/0417 219/536

(Continued)

*Primary Examiner* — Woody A Lee, Jr.
(74) *Attorney, Agent, or Firm* — Kenneth A. Smith

(57) ABSTRACT

Disclosed is a portable radiant heating device that has a base, a radiant heat source mounted in a tiltable reflector, and a safety interlock device located in the base. The safety interlock uses a pressure-sensitive foot that prevents the heater from producing infrared heat when not in contact with a mounting surface. The safety interlock device also prevents the heater from producing infrared heat when the reflector is not tilted so as to prevent excessive amounts of infrared heat from being directed towards the mounting surface.

16 Claims, 13 Drawing Sheets

(56) References Cited

U.S. PATENT DOCUMENTS

| | | | | |
|---|---|---|---|---|
| 5,769,025 | A * | 6/1998 | van der Lely | A01J 9/00 119/14.08 |
| 5,865,095 | A * | 2/1999 | Mulle | A47J 31/42 99/293 |
| 5,947,268 | A * | 9/1999 | Lange | B60Q 1/441 200/345 |
| 6,340,298 | B1 * | 1/2002 | Vandrak | F24C 3/14 126/110 B |
| 6,618,022 | B2 * | 9/2003 | Harvey | H03K 17/94 343/876 |
| 7,060,917 | B1 * | 6/2006 | Park | H01H 13/52 200/520 |
| 7,064,639 | B2 * | 6/2006 | Harvey | H01H 73/44 335/167 |
| 9,053,877 | B2 * | 6/2015 | Young | H01H 13/14 |
| 9,679,712 | B2 * | 6/2017 | Nohra | G08C 23/04 |
| 12,169,071 | B2 * | 12/2024 | Goodman | F24H 9/2085 |
| 2002/0149465 | A1 * | 10/2002 | Morbitzer | H01H 37/20 337/392 |
| 2004/0106080 | A1 * | 6/2004 | Vandrak | F24C 15/24 432/224 |
| 2005/0075581 | A1 * | 4/2005 | Schwindt | A61M 1/77 600/568 |
| 2008/0217146 | A1 * | 9/2008 | Albrecht | H01H 11/06 200/266 |
| 2009/0287150 | A1 * | 11/2009 | Dacquay | A61F 9/0017 604/114 |
| 2012/0145699 | A1 * | 6/2012 | McMahan | H05B 3/0076 219/533 |
| 2015/0294807 | A1 * | 10/2015 | Benson, IV | H01H 3/001 200/290 |
| 2021/0041140 | A1 * | 2/2021 | Green | F24H 3/002 |

* cited by examiner

TILTABLE RADIANT HEATER

CROSS REFERENCE TO RELATED APPLICATIONS

This application claims priority to U.S. Provisional application 63/224,042 filed on Jul. 21, 2021, which is incorporated herein by reference in its entirety.

TECHNICAL FIELD

The present invention is directed to the field of portable radiant heaters. More specifically, the present invention is directed to a tiltable portable radiant heater with a base that contains safety interlocks that prevent the operation of the portable radiant heater in certain configurations.

BACKGROUND

Portable heating devices ordinarily use one of two methods to provide warmth to an individual, animal, or some sort of device or system. The first of these methods involves warming the air in the space where the individual, animal, device, or system is located. These heating devices function well but are not energy efficient as they must warm the air in the entire space in order to provide warmth to the individual, animal, etc. The second of these methods uses radiant heat. In these second type of heaters an infrared heat source directs infrared heat onto the intended target (individual, animal, etc.). In order to improve efficiency, radiant heaters often have reflective elements to direct the infrared heat toward an intended target. The addition of a reflective element often means that the portable radiant heater is required to be oriented such that the infrared heat is directed toward the intended target. A common method of orienting portable heating devices is to provide a base that can be placed on a floor or other flat mounting surface. While convenient for placement in an area of a room, if the intended target is located at other than a fixed height from the mounting surface, a portable radiant heater may not effectively direct heat toward the target. In other words, the heat may be focused below or above a main portion of the target. What is needed is a portable radiant heating device that can be adjusted to direct heat up or down to provide radiant heat to the main portion of the target while protecting mounting surfaces from excessive heating.

SUMMARY

Embodiments relate to devices for focusing and directing radiant heat to a target area. More specifically, exemplary embodiments of a radiant heater comprise a base, a source of infrared heat, a reflector, a safety screen mounted to the reflector, a flexible connection between the base and the reflector that permits the reflector to tilt upwards or downwards, where the base further comprises a safety interlock that prevents the source of infrared heat from energizing when the base is not in contact with a mounting surface. The safety interlock also prevents the source of infrared heat from energizing when the reflector is oriented such that a portion of the infrared heat is directed toward the mounting surface.

The above summary is not intended to describe each illustrated embodiment or every implementation of the invention. Rather, the exemplary embodiments are chosen and described to provide an overview or framework for understanding the nature and character of the claimed aspects and implementations so that those skilled in the art can appreciate and understand the principles and practices of the invention. The Figures and the detailed description that follow more particularly exemplify these exemplary embodiments, and are incorporated in and constitute a part of this specification.

BRIEF DESCRIPTION OF THE DRAWINGS

These and other features and advantages of the present invention will become better understood with regard to the following description and accompanying drawings in which.

Figure 1:
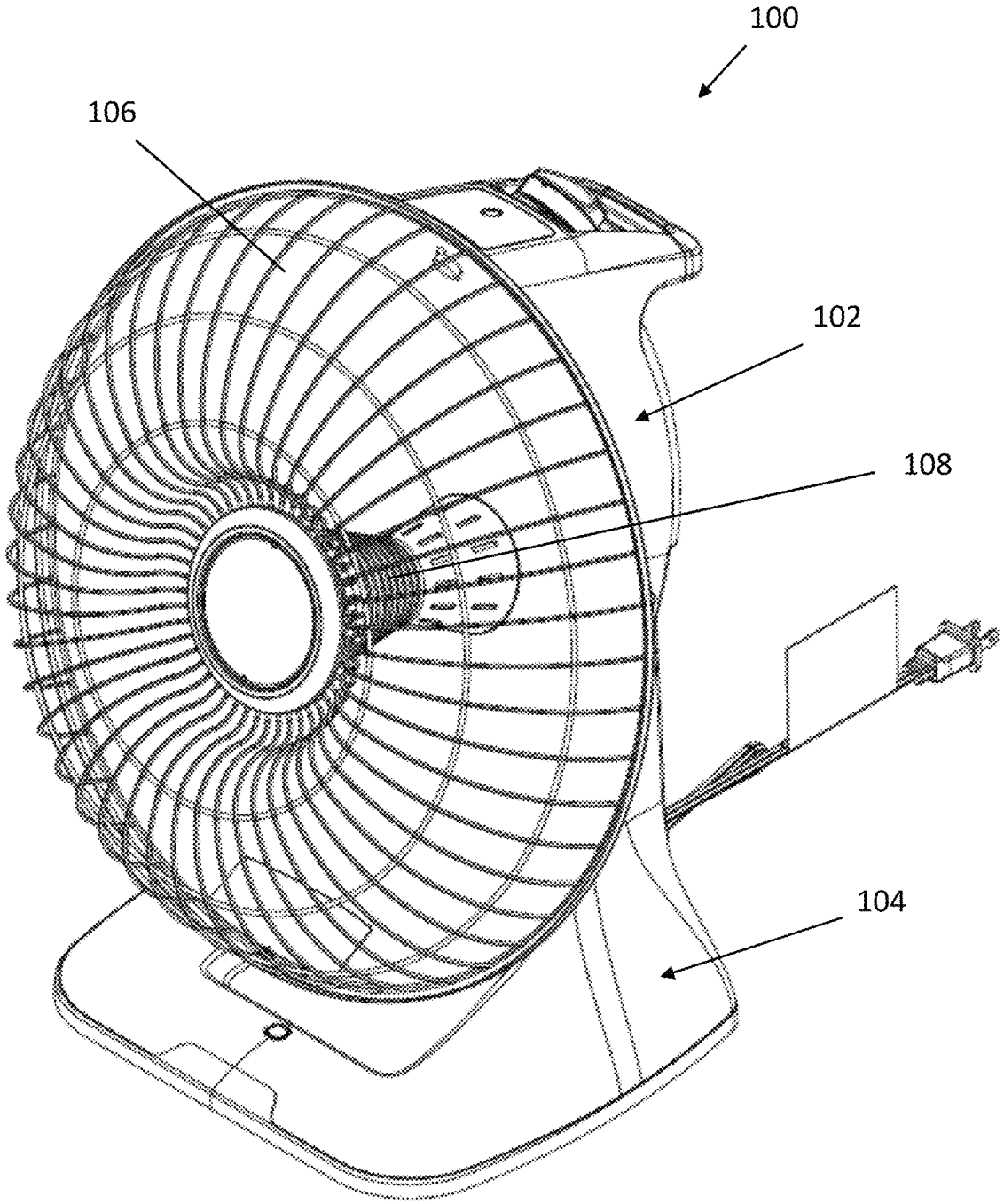
FIG. 1 is a top right perspective view of a radiant heater according to an exemplary embodiment.
Figure 2:
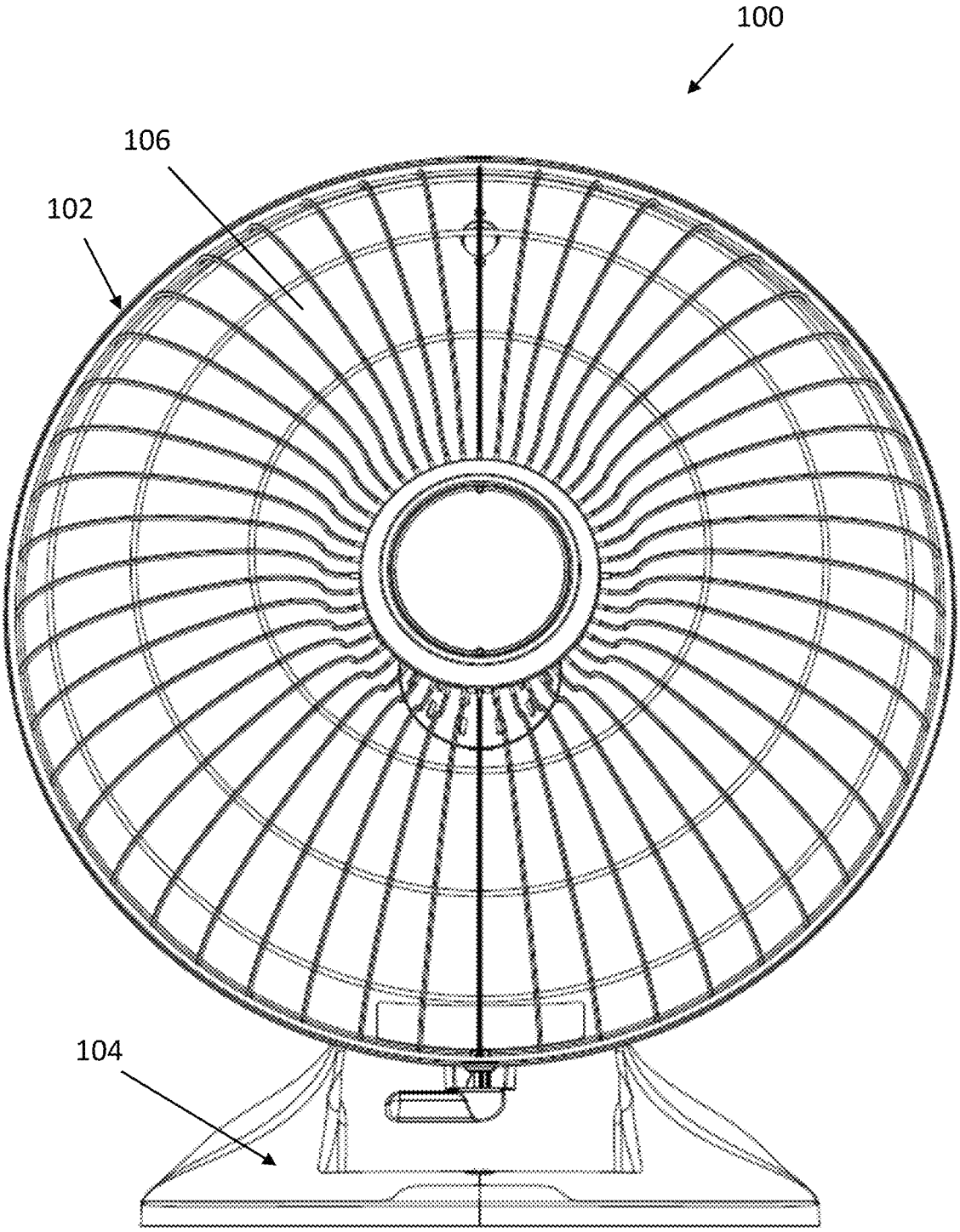
FIG. 2 is a front view of the radiant heater of FIG. 1.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Figure 7:
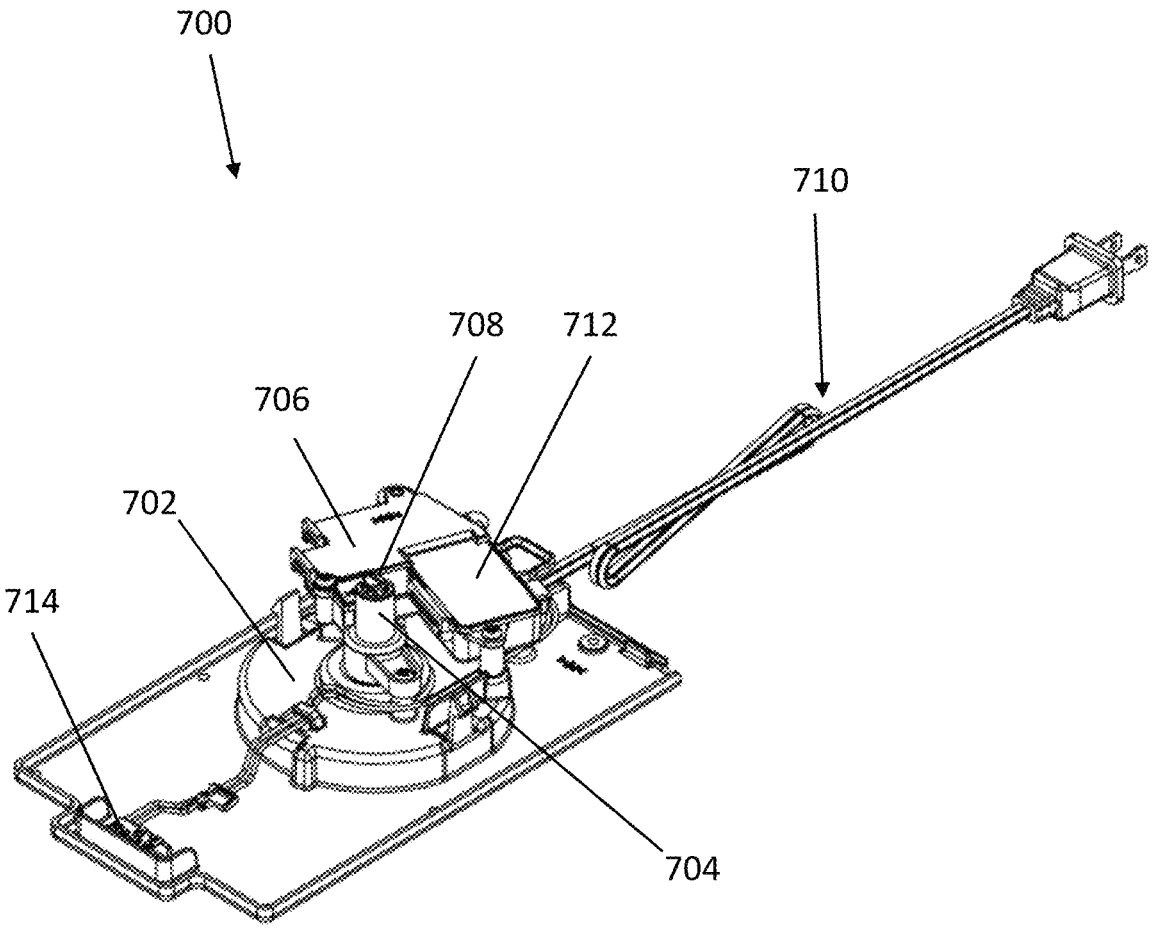
FIG. 7 is a perspective view of a base safety interlock assembly of the radiant heater of FIG. 1.
Figure 8A:
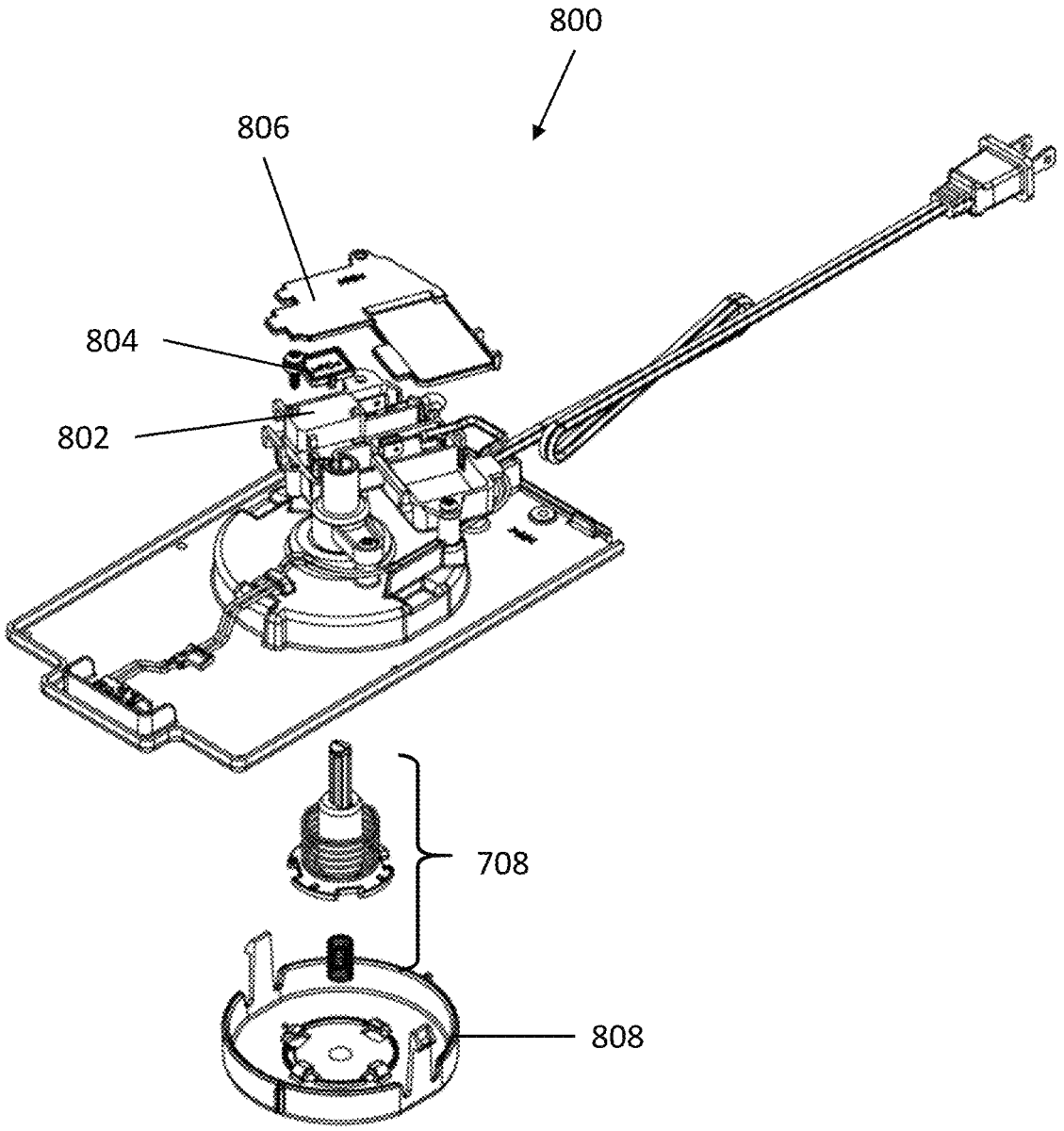
FIG. 8A is an exploded view of a base safety interlock assembly of FIG. 7.
Figure 8B:
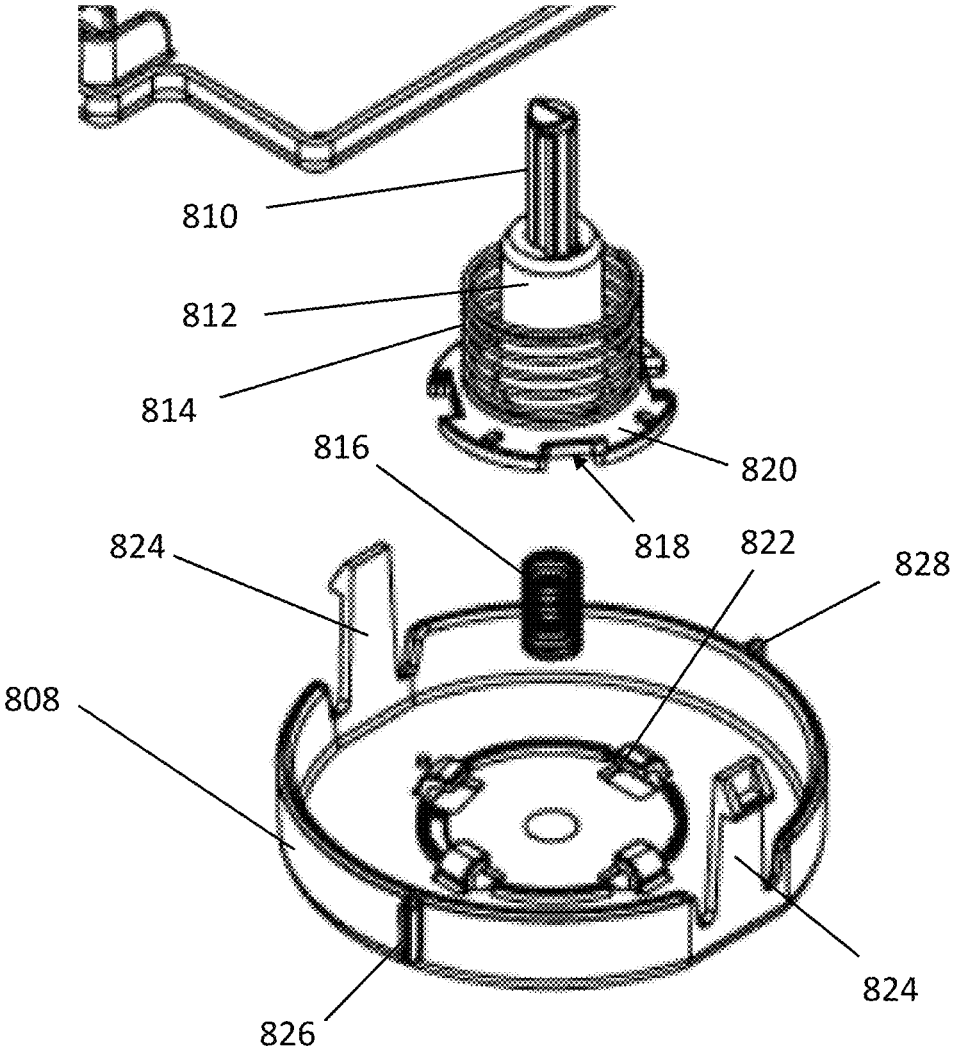
FIG. 8B is an enlarged view of a plunger foot assembly of the base safety interlock assembly of FIG. 8A.
Figure 9:
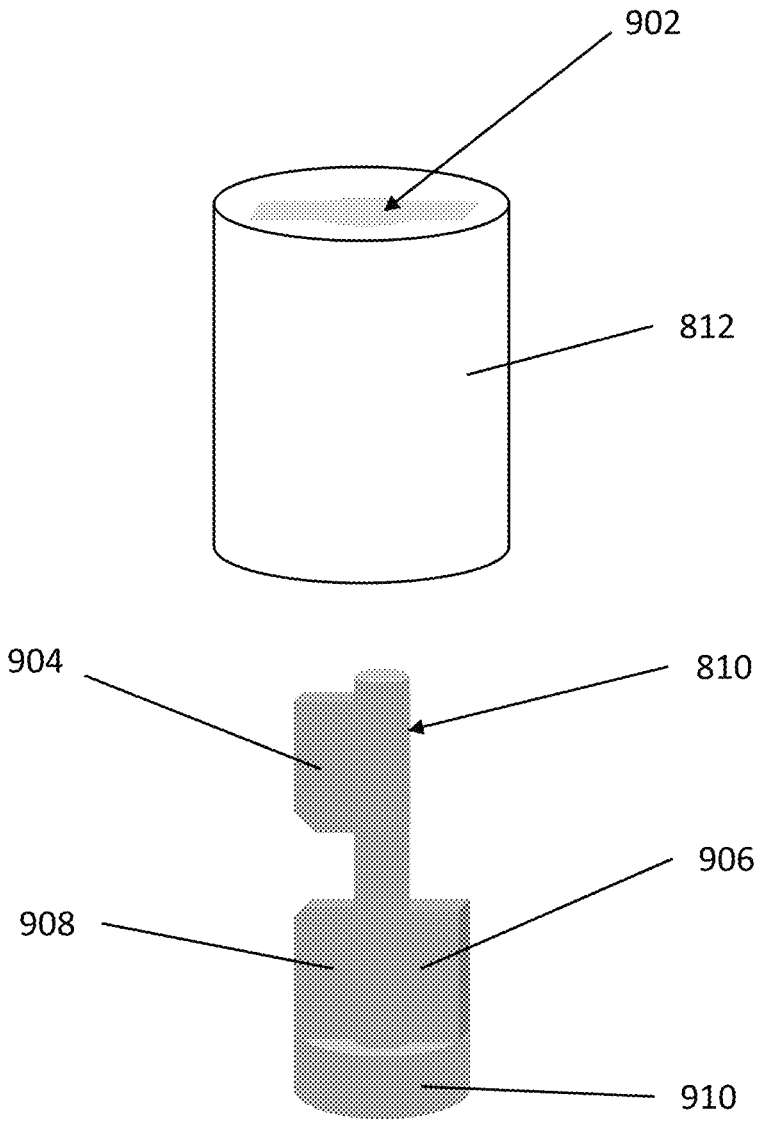
FIG. 9 is an exploded diagram of a plunger subassembly of the base safety interlock assembly of FIG. 7.

FIGS. 1-6 illustrate various views of an exemplary portable radiant heating device 100. As illustrated in FIGS. 1-6, the radiant heating device comprises a heater assembly 102 and a base assembly, 104. The heater assembly 102 comprises a reflector 106 and a heat source 108. FIG. 7 illustrates a safety interlock assembly 700 according to an exemplary embodiment. The exemplary embodiment of the safety interlock assembly 700 comprises a plunger foot receiving cavity 702, a plunger shaft column 704, a switch housing 706 which houses the disconnect switch (not shown), and a plunger assembly 708. Also illustrated are an electrical cord 710, an electrical connection enclosure 712, and an indicator lamp 714. Certain of these components may not be present in all exemplary embodiments. FIG. 8 is an exploded view 800 of the safety interlock assembly 700 of FIG. 7. Illustrated are the disconnect switch 802, switch fixing plate 804, and enclosure cover 806. The plunger assembly 708 is illustrated in an exploded view. Also shown is the plunger foot 808. Referring now to FIG. 8B which illustrates an enlarged view of the plunger assembly 708 and the plunger foot 808. As illustrated, an exemplary embodiment of a plunger assembly 708 comprises a plunger shaft 810, a plunger collar 812, an upper spring 814, and a lower spring 816. As illustrated, the plunger collar 812 is formed with cutouts 818 and tabs 820 formed between the cutouts 818. The cutouts 818 engage with capture fingers 822 formed in the plunger foot 808. When the plunger collar 812 is arranged such that the cutouts 818 align with the capture fingers 822, the tabs 820 are captured by capture fingers 822 such that the plunger collar 812 is held against the plunger foot 808. When in such a position, the lower spring 816 is held between the plunger foot 808 and the plunger shaft 810 such that the plunger shaft 810 is held by the lower spring 816 in a completely extended position relative to the plunger collar 812. In certain exemplary embodiments, the size and spacing of the cutouts 818 and capture fingers 822 are arranged such that the plunger collar 812 is only installable in one rotational orientation relative to the axis of the plunger foot 808. As illustrated in FIG. 9, the plunger collar 812 (shown without cutouts and tabs) comprises an opening 902 that is configured to align the flanges 904, 906, and 908 found on the plunger shaft 810 relative to the plunger foot 808. Thus, the plunger shaft 810 is held in a constant rotational orientation relative to the plunger foot 808. Also visible is a lower collar 910 portion of the plunger shaft 810. This lower collar 910 serves to prevent the plunger shaft 810 from escaping from the plunger collar 812 when held in an extended position by the lower spring 816. Referring again to FIG. 8B, the plunger foot 808 comprises two mounting tabs 824 that engage openings formed in the plunger foot receiving cavity 702. The plunger foot 808 also comprises alignment fins 826 and 828 that engage alignment slots (not shown) located in the plunger foot receiving cavity 702. The interaction between the alignment slots and the alignment fins 826 and 828 serves to ensure that the plunger foot 808 be held in a consistent rotational alignment relative to the plunger foot receiving cavity 702. The combination of the plunger foot alignment and the plunger shaft alignment results in a consistent rotational alignment of the plunger shaft 810 relative to the plunger shaft column 704 and thus the disconnect switch 802.

Figure 3:
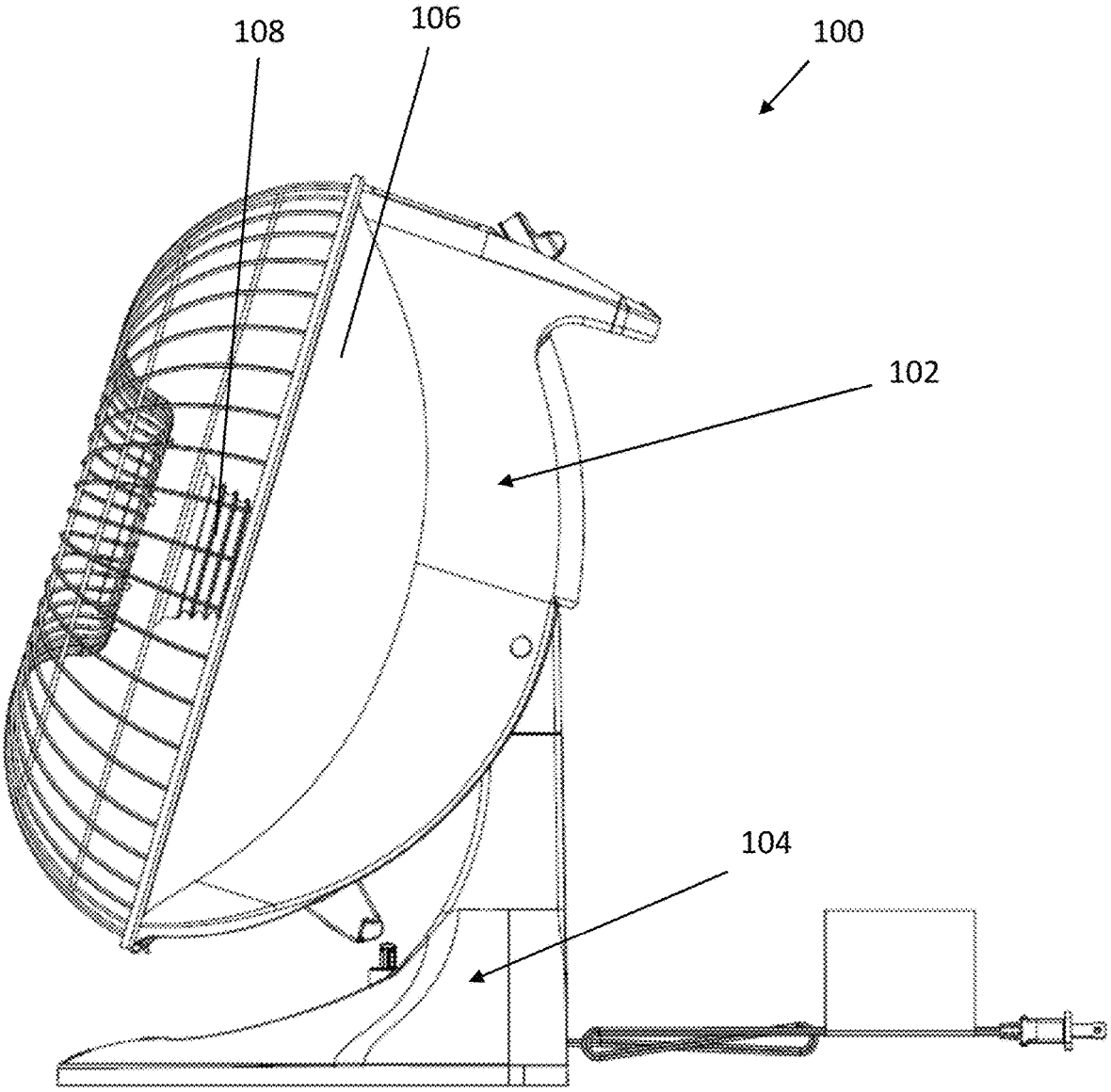
FIG. 3 is a right-side view of the radiant heater of FIG. 1.
Figure 4:
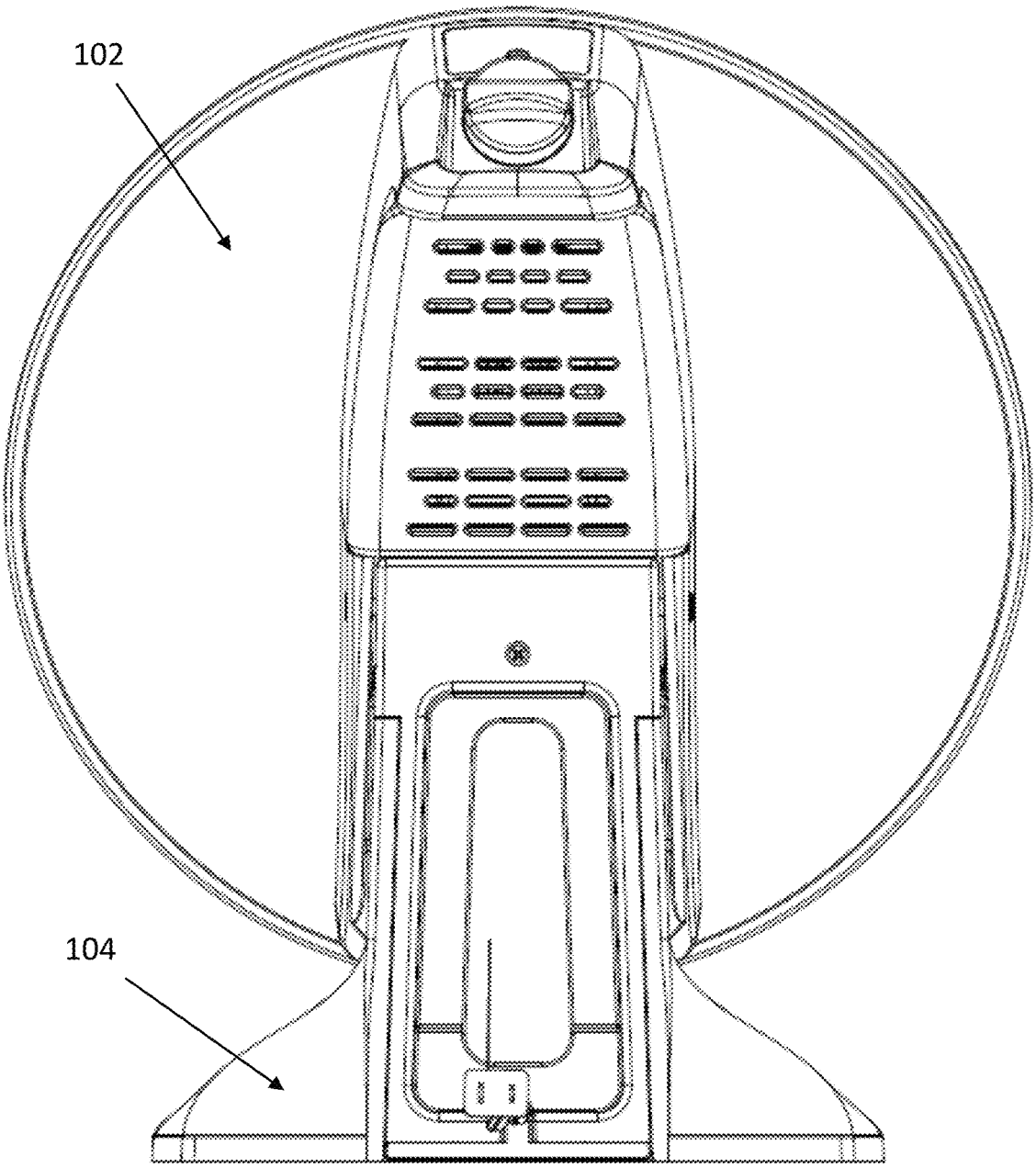
FIG. 4 is a rear view of the radiant heater of FIG. 1.
Figure 5:
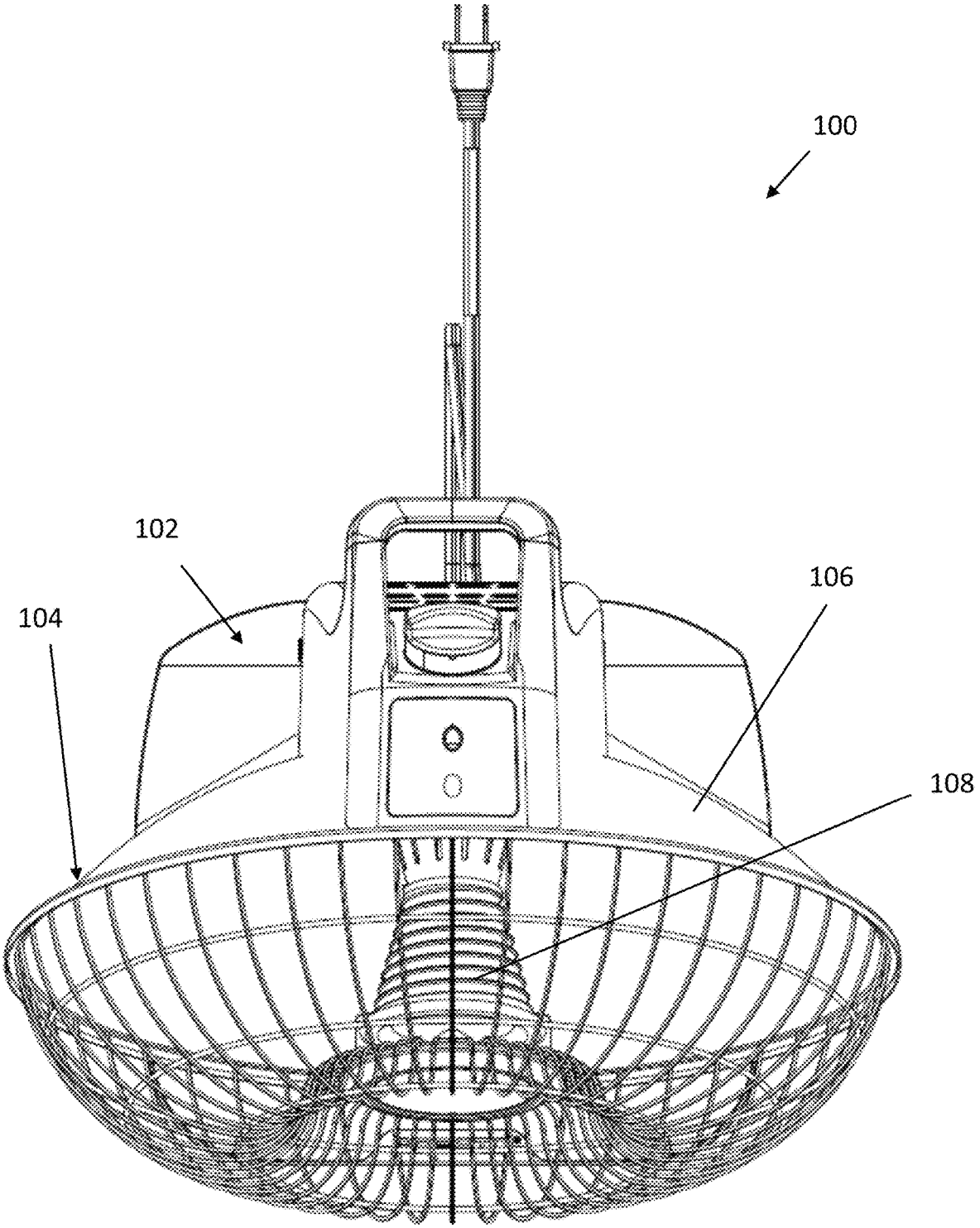
FIG. 5 is a top view of the radiant heater of FIG. 1.
Figure 6:
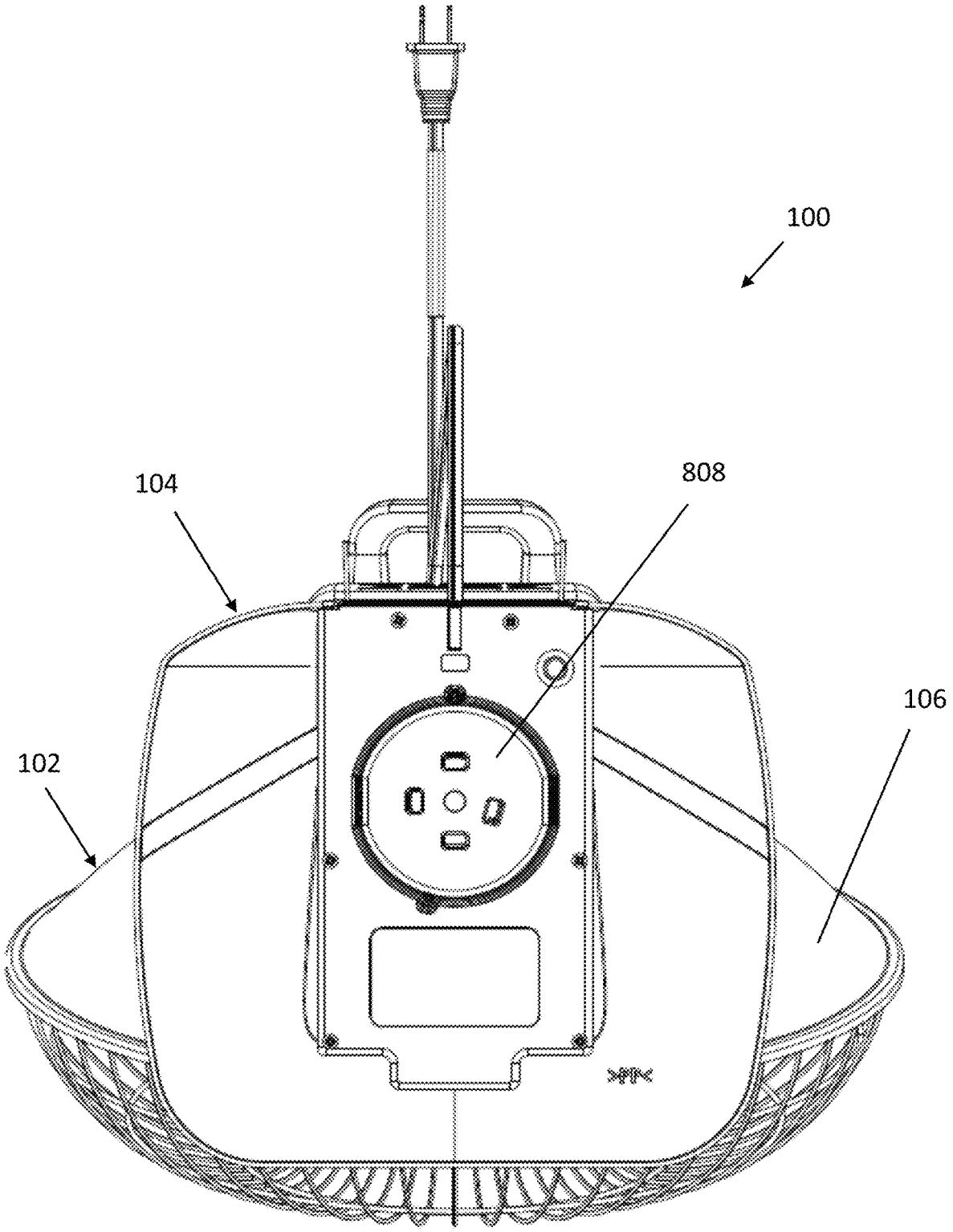
FIG. 6 is a bottom view of the radiant heater of FIG. 1.
Figure 10:
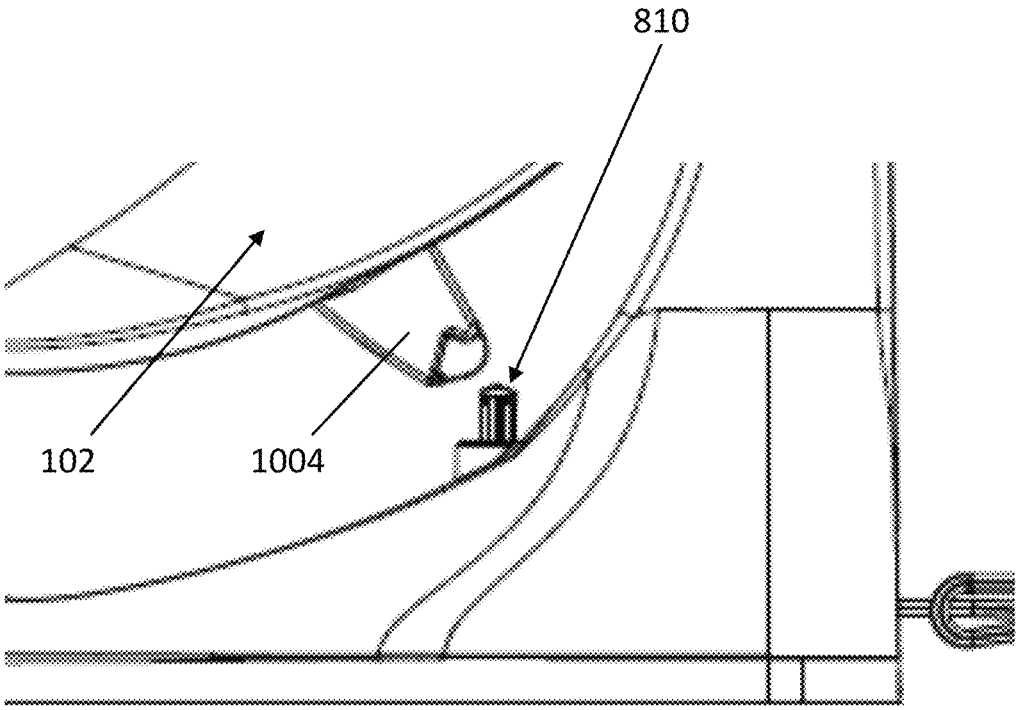
FIG. 10 is an enlarged view of FIG. 3 showing the plunger subassembly in position to make contact with a safety interlock arm of a heater assembly of the radiant heater.

FIG. 10 illustrates an enlarged portion of FIG. 3 which illustrates the heater assembly 102 of a portable radiant heating device 100 in a partially rotated position. Shown is an engagement finger 1004. The engagement finger 1004 is oriented such that when the heater assembly 102 is lowered to its lowest rotated position and thus proximate to a mounting surface such as a floor or tabletop (not illustrated), the engagement finger 1004 contacts the plunger shaft 810. When the engagement finger 1004 contacts the plunger shaft 810 force exerted by the lower spring 816 is overcome such that the plunder shaft 810 is partially depressed.

Figure 11A:
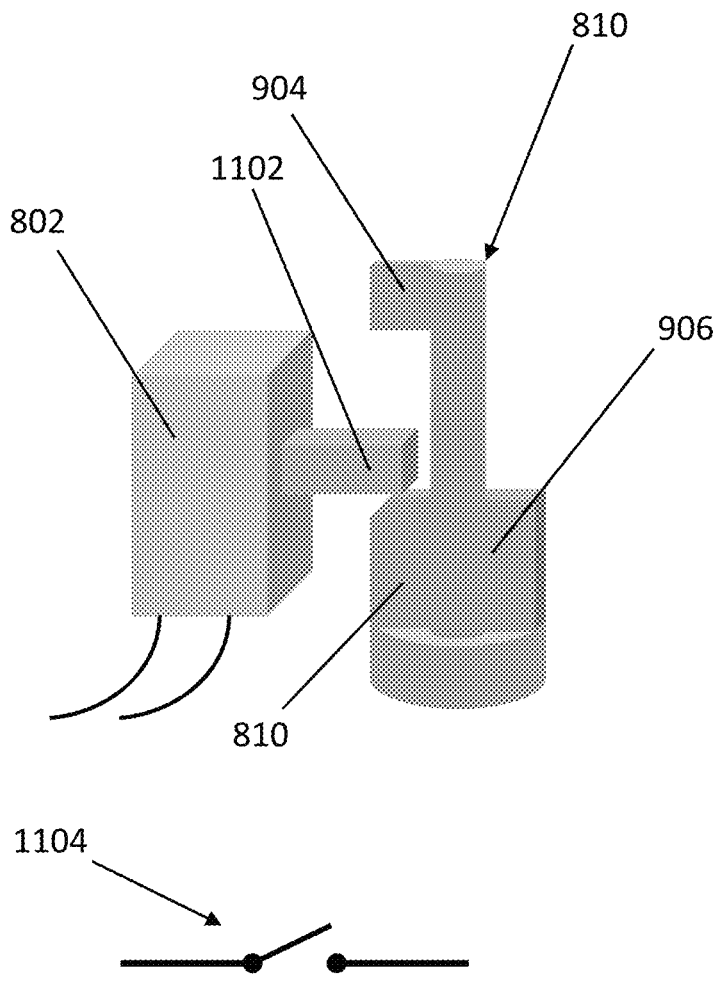
FIG. 11A is an illustration of a safety interlock switch not interacting with the plunger subassembly of the base safety interlock assembly of FIG. 7 where the plunger subassembly is disengaged from the safety interlock switch.
Figure 11B:
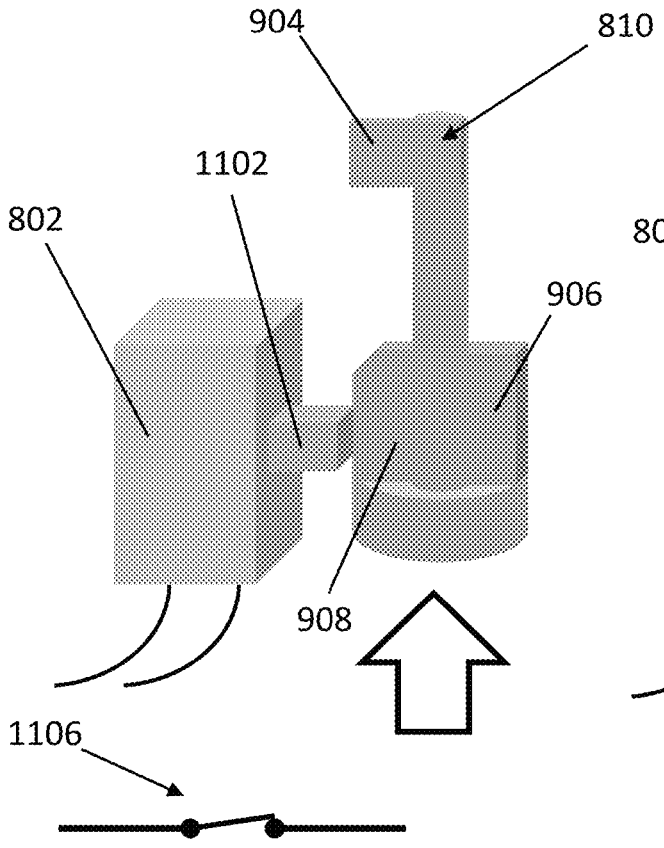
FIG. 11B is an illustration of a safety interlock switch interacting with the plunger subassembly of the base safety interlock assembly of FIG. 7 where the plunger subassembly engages the safety interlock switch.

As illustrated in FIG. 11A, when the portable radiant heating device 100 is not in contact with the mounting surface such as a floor or tabletop, the plunger foot 808 is held in a position by the upper spring 814 wherein the plunger foot 808 extends out of the plunger foot receiving cavity 702 such that a portion of the plunger foot 808 extends below the bottom of the safety interlock assembly 700. As is shown, in such an arrangement the flange 908 is not in contact with the actuator 1102 of the disconnect switch 802. As a result, the switch is "open" or not conducting electrical current as shown in the schematic switch diagram at 1104. When the portable radiant heating device 100 rests on the mounting surface, the weight of the portable radiant heating device 100 overcomes the spring force applied by the upper spring 814 such that the plunger foot 808 is pressed into the plunger foot receiving cavity 702. When this occurs, the plunger collar 812 moves upward and causes the plunger shaft 810 to move upward relative to the disconnect switch 802. This is illustrated in FIG. 11B where the flange 908 causes the actuator 1102 of the disconnect switch 802 to close the switch as illustrated in the schematic switch diagram at 1106. In an exemplary embodiment, an electrical current is allowed to flow into a source of infrared heat (not shown in FIGS. 11A-11C).

Figure 11C:
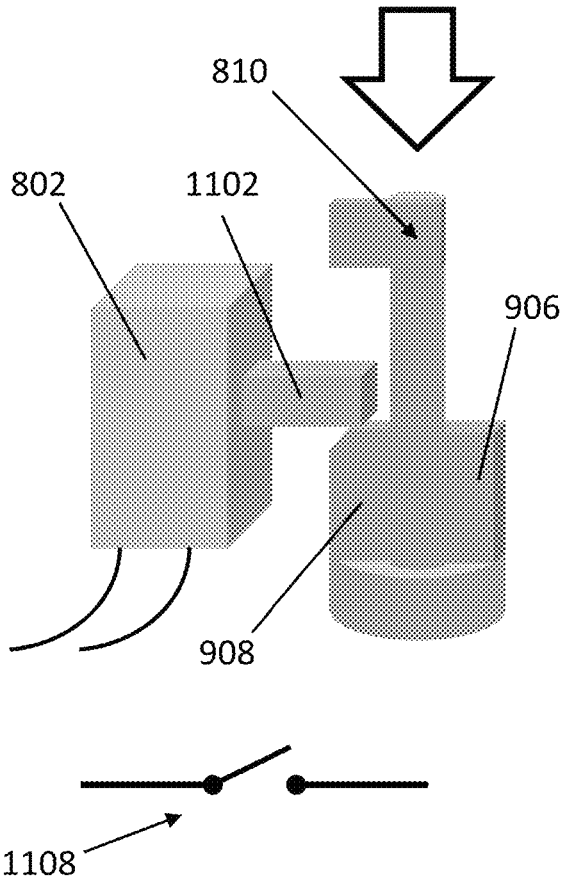
FIG. 11C is an illustration of a safety interlock switch interacting with the plunger subassembly of the base safety interlock assembly of FIG. 7 where the plunger subassembly is disengaged from the safety interlock switch.

In order to prevent damage caused by infrared heat being applied to the mounting surface, the source of infrared heat should be disabled when the heater assembly 102 of the portable radiant heating device 100 is in a lowered orientation. As we described in the discussion of FIG. 10, when the heater assembly 102 is in a lowered orientation, the engagement finger 1004 contacts the plunger shaft 810, causing the plunder shaft 810 to be partially depressed. When the plunger shaft 810 is depressed, the tension of the lower spring is overcome such that the plunger shaft 810 is pressed into the plunger collar 812. As illustrated in FIG. 11C, when this occurs the flange 908 moves below the actuator 1102 of the disconnect switch 802 such that the switch opens as illustrated in the schematic switch diagram 1108. The result is that electrical energy is not applied to the source of infrared heat such that damage to the mounting surface is avoided. In addition to avoidance of damage, these disconnect operations can prevent the infrared heat source from causing surfaces from being damaged or catching fire should the portable radiant heater be disturbed or otherwise tip over.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations, and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

Any implementation or embodiment disclosed herein can be combined with any other implementation or embodiment, and references to "an implementation," "some implementations," "one implementation," "an embodiment," "some embodiments," "certain embodiments," or the like are not necessarily mutually exclusive and are intended to indicate that a particular feature, structure, or characteristic described in connection with the implementation can be included in at least one implementation or embodiment. Such terms as used herein are not necessarily all referring to the same implementation. Any implementation or embodiment can be combined with any other implementation or embodiment, inclusively or exclusively, in any manner consistent with the aspects and implementations disclosed herein.

Where technical features in the drawings, detailed description, or any claim are followed by reference numbers, the reference numbers have been included to increase the intelligibility of the drawings, detailed description, and claims. Accordingly, neither the reference numbers nor their absence have any limiting effect on the scope of any claim elements.

Coupled elements can be electrically, magnetically, mechanically, or physically coupled with one another directly or with intervening elements. Scope of the systems and methods described herein is thus indicated by the appended claims, rather than the foregoing description, and changes that come within the meaning and range of equivalency of the claims are embraced therein.

References to "or" can be construed as inclusive so that any terms described using "or" can indicate any of a single, more than one, and all of the described terms. A reference to "at least one of 'A' and 'B'" can include only 'A', only 'B', as well as both 'A' and 'B'. Such references used in conjunction with "comprising" or other open terminology can include additional items.

Modifications of described elements and acts such as variations in sizes, dimensions, structures, shapes, and proportions of the various elements, values of parameters, mounting arrangements, use of materials, colors, or orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes, and omissions can also be made in the design, operating conditions, and arrangement of the disclosed elements and operations without departing from the scope of the present disclosure.

References herein to the positions of elements (e.g., "top," "bottom," "above," "below") are merely used to describe the orientation of various elements in the Figures. The orientation of various elements may differ according to other exemplary embodiments, and that such variations are intended to be encompassed by the present disclosure.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations, and locations, etc. have been described for use with disclosed embodiments, others besides those disclosed may be utilized without exceeding the scope of the claimed inventions.

What is claimed is:

1. A safety interlock system for a portable radiant heating device, the system comprising:

a disconnect switch;

an engagement finger;

a plunger shaft; and a plunger foot;

wherein the plunger shaft comprises a first flange, a second flange, and a recess formed between the first and second flange;

wherein the plunger shaft is movably attached to the plunger foot, the safety interlock system further comprising a second spring which exerts a spring force against the plunger shaft such that plunger shaft is held in a first position by the spring force, the plunger shaft movable to a second position when the spring force is overcome; and wherein an actuator of the disconnect switch is actuated by the second flange when the portable radiant heater is in a normal condition such that the disconnect switch is closed.

2. The safety interlock system of claim 1, further comprising a first spring which applies a force to the plunger foot such that it extends from a base portion of the portable heating device.

3. The safety interlock system of claim 2, wherein the actuator of the disconnect switch is de-actuated when the plunger foot extends from the base portion of the portable heating device such that the disconnect switch is opened.

4. The safety interlock system of claim 1, wherein the disconnect switch is de-actuated when the plunger shaft is in the second position.

5. The safety interlock system of claim 4, wherein the engagement finger contacts the plunger shaft to cause the plunger shaft to be in the second position.

6. The safety interlock system of claim 1, further comprising a plunger collar, the plunger collar configured to trap the plunger shaft between the plunger collar and the plunger foot.

7. The safety interlock system of claim 6, the plunger collar rotationally aligning the plunger shaft with the plunger foot and adapted to allow the plunger shaft to move from a first position to a second position.

8. The safety interlock system of claim 7, the plunger foot comprising alignment fins to rotationally align the plunger foot with a radiant heater base, the radiant heater base comprising a mount for the disconnect switch such that the disconnect switch is rotationally aligned with the second flange of the plunger shaft.

9. A portable electric heater comprising:

a heater assembly comprising:

a reflector;

a heating element;

a grating; and an engagement finger;

a base flexibly connected to the heating assembly such that the heating assembly can be tilted from a storage position to a heating position, the base comprising:

a disconnect switch;

a plunger shaft; and a plunger foot;

wherein the plunger shaft comprises a first flange, a second flange, and a recess formed between the first and second flange;

a first spring which applies a force to the plunger foot such that the plunger foot extends from the base portion of the portable heating device when the base portion is not in contact with a placement surface;

wherein the plunger shaft is movably attached to the plunger foot, the safety interlock system further comprising a second spring which exerts a spring force against the plunger shaft such that plunger shaft is held in a first position by the spring force, the plunger shaft movable to a second position when the spring force is overcome;

wherein an actuator of the disconnect switch is actuated by the second flange when the portable radiant heater is in the heating condition such that the disconnect switch is closed; and wherein the actuator of the disconnect switch is de-actuated when the plunger foot extends from the base portion of the portable electric heater device such that the disconnect switch is opened.

10. The portable electric heater of claim 9, wherein the disconnect switch is de-actuated when the plunger shaft is in the second position.

11. The portable electric heater of claim 10, wherein the engagement finger contacts the plunger shaft causing the plunger shaft to be in the second position when the heating assembly is in the storage position.

12. The portable electric heater of claim 9, further comprising a plunger collar, the plunger collar configured to trap the plunger shaft between the plunger collar and the plunger foot.

13. The portable electric heater of claim 12, the plunger collar rotationally aligning the plunger shaft with the plunger foot and adapted to allow the plunger shaft to move from a first position to a second position.

14. The portable electric heater of claim 13, the plunger foot comprising alignment fins to rotationally align the plunger foot with a radiant heater base, the radiant heater base comprising a mount for the disconnect switch such that the disconnect switch is rotationally aligned with the second flange of the plunger shaft.

15. A method of preventing the operation of a portable electric heater when the heater is in a storage configuration, the method comprising:

providing a portable electric heater, the heater comprising:

a heater assembly, the heater assembly further comprising:

a reflector;

a heating element;

a grating; and an engagement finger;

a base flexibly connected to the heating assembly such that the heating assembly can be tilted from a storage configuration to a heating configuration, the base comprising:

a disconnect switch;

a plunger shaft; and a plunger foot;

wherein the plunger shaft comprises a first flange, a second flange, and a recess formed between the first and second flange;

wherein the plunger shaft is movably attached to the plunger foot, the safety interlock system further comprising a second spring which exerts a spring force against the plunger shaft such that plunger shaft is held in a first position by the spring force, the plunger shaft movable to a second position when the spring force is overcome; and contacting the plunger shaft with the engagement finger to cause the plunger shaft to be in the second position when the heating assembly is in the storage position, the disconnect switch opens to prevent a flow of electrical power to the heating element when the plunger shaft is in the second position.

16. The method of claim 15, wherein the plunger shaft is movably attached to the plunger foot, the base further comprising a spring which exerts a spring force against the plunger shaft such that plunger shaft is held in a first position by the spring force, the plunger shaft movable to the second position when the spring force is overcome.

* * * * *